US006639346B2

(12) United States Patent
Bae et al.

(10) Patent No.: US 6,639,346 B2
(45) **Date of Patent: *Oct. 28, 2003**

(54) CRT PANEL AND A METHOD FOR MANUFACTURING THE SAME

(75) Inventors: Sung-Ryong Bae, Yangsan (KR); Jong-Hwan Park, Suwon (KR); Yun-Hee Kim, Seoul (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 164 days.

This patent is subject to a terminal disclaimer.

(21) Appl. No.: 09/845,032

(22) Filed: May 1, 2001

(65) Prior Publication Data

US 2002/0027411 A1 Mar. 7, 2002

Related U.S. Application Data

(63) Continuation-in-part of application No. 09/209,546, filed on Dec. 11, 1998, now Pat. No. 6,356,012.

(30) Foreign Application Priority Data

Dec. 17, 1997 (KR) ..... 97-69884

(51) Int. Cl.[7] ..... H01J 29/10
(52) U.S. Cl. ..... 313/461; 313/478; 313/479
(58) Field of Search ..... 313/478–480, 313/461, 473, 112, 114, 116

(56) References Cited

U.S. PATENT DOCUMENTS

| | | | | |
|---|---|---|---|---|
| 3,879,627 A | | 4/1975 | Robinder | |
| 4,537,322 A | | 8/1985 | Okada et al. | 220/2.1 |
| 4,841,372 A | | 6/1989 | Lee | |
| 4,945,282 A | * | 7/1990 | Kawamura et al. | 313/479 |
| 4,965,975 A | * | 10/1990 | Schwarz | 52/308 |
| 4,985,658 A | | 1/1991 | Canevazzi | 313/477 |
| 5,045,750 A | | 9/1991 | Itou et al. | |
| 5,107,999 A | | 4/1992 | Canevazzi | 220/2.1 |
| 5,108,960 A | * | 4/1992 | Boek et al. | 501/64 |
| 5,155,410 A | | 10/1992 | Wakasono et al. | 313/402 |
| 5,216,321 A | | 6/1993 | Kawamura et al. | 313/479 |
| 5,386,174 A | | 1/1995 | Ishii | 313/408 |
| 5,717,282 A | * | 2/1998 | Oomen et al. | 313/479 |
| 5,814,933 A | | 9/1998 | Iwata et al. | 313/477 |
| 5,945,780 A | * | 8/1999 | Ingle et al. | 313/495 |
| 6,084,343 A | * | 7/2000 | Van De Poel et al. | 313/478 |
| 6,087,012 A | * | 7/2000 | Varaprasad et al. | 428/428 |
| 6,133,686 A | | 10/2000 | Inoue | 313/477 |
| 6,150,756 A | * | 11/2000 | Wakelkamp et al. | 313/479 |
| 6,465,947 B1 | * | 10/2002 | Tojo et al. | 313/478 |

FOREIGN PATENT DOCUMENTS

| | | |
|---|---|---|
| JP | 6-44926 | 2/1994 |
| JP | 06036710 | 2/1994 |

* cited by examiner

*Primary Examiner*—Nimeshkumar D. Patel
*Assistant Examiner*—Anthony Perry
(74) *Attorney, Agent, or Firm*—Lee & Sterba, P.C.

(57) ABSTRACT

A panel defining a front exterior of a cathode ray tube has an inner surface overlaid with a phosphor screen, and an outer surface overlaid with a tinted coating layer, wherein the tinted coating layer varies light transmission at the center and the periphery of the panel by being dark at the center and gradating brighter toward the periphery thereby preventing a difference in brightness of the panel between the center and the periphery thereof due to incremental growth in the volume of a black matrix and in the thickness of the panel toward the periphery.

17 Claims, 5 Drawing Sheets

CRT PANEL AND A METHOD FOR MANUFACTURING THE SAME

RELATED APPLICATION INFORMATION

This application is a continuation-in-part application of U.S. patent application Ser. No. 09/209,546, filed on Dec. 11, 1998, which is incorporated by reference herein in its entirety.

BACKGROUND OF THE INVENTION

1. Field of the Invention

The present invention relates to a panel for a cathode ray tube (CRT). More particularly, the present invention relates to a CRT panel and a method for manufacturing the same in which the entire area of a viewing screen is uniformly illuminated.

2. Description of the Related Art

Cathode ray tubes generally comprise a panel defining a front exterior of the CRT, and a funnel joined to the panel to define a rear exterior of the CRT. The funnel includes a neck formed on an end of the funnel opposite to the end joined to the panel, and an electron gun provided in the neck of the funnel. The panel includes a display portion defining a distal end of the panel, a curved lateral wall that extends toward the funnel to be joined to the same, a phosphor screen provided adjacent to the display portion within the CRT, a mask frame connected to the lateral wall of the panel, and a shadow mask joined to the mask frame at a predetermined distance from the phosphor screen. The electron gun radiates red (R), green (G) and blue (B) electron beams in a direction toward the panel. The RGB electron beams are controlled by image signals such that the beams are deflected to specific pixels by an electrical field generated by a deflection yoke. The deflection yoke is disposed on an outer circumference of the funnel. The deflected electron beams pass through apertures of the shadow mask to land on specific RGB phosphor pixels of the phosphor screen such that color selection of the electron beams by the shadow mask is realized. Accordingly, the RGB phosphors of the phosphor screen are illuminated for the display of color images.

FIG. 7 illustrates a conventional shadow mask 1 having apertures 3 formed therein, wherein a space between each of the apertures 3 increases toward a periphery of the shadow mask 1. That is, the positions of the apertures 3 on the shadow mask 1, where the electron beams land, become spaced further apart toward outer edges of the shadow mask. This configuration corresponds to incremental increases in the degree of deflection of the electron beams by the deflection yoke toward the periphery of the shadow mask 1. Without this structure, the electron beams would pass through their designated apertures 3 at the center of the shadow mask 1, but not at the peripheries.

With the formation of the shadow mask as in the above, however, the RGB phosphor pixels on the phosphor screen must also be formed in their dot or stripe matrices with spaces corresponding to the spaces formed between the apertures of the shadow mask. Accordingly, the area of a light-absorbing black matrix layer formed between the dot- or stripe-type phosphor pixels enlarges such that brightness is reduced toward the periphery of the display portion.

Therefore, the illumination over the surface of the viewing screen becomes uneven with the center of the viewing screen being brighter than the outer peripheral portions. Assuming that the degree of darkness at the center of the phosphor screen is indexed at 100, the degree of darkness at the periphery of the phosphor screen is 120. In the stripe-type CRT, this translates into a 50% reduction in brightness at the periphery of the display, whereas in the dot-type CRT, this results in a 30% decrease in peripheral brightness.

Meanwhile, the CRT is internally kept in a high vacuum state of $10^{-7}$ torr or less and, therefore, stress may concentrate on the periphery of the panel. In order to prevent such stress concentration, the thickness of the panel at the periphery is larger than that at the center. With the thickness increasing toward the periphery of the panel, the light transmission of the panel becomes gradually reduced toward the periphery of the panel so that the difference in brightness between the center and the periphery of the panel is significant.

Further, as CRTs become flatter, following advances made in CRT technology, the above problem worsens. Specifically, differences in the spaces between the apertures of the shadow mask from the center to the periphery of the shadow mask, and therefore the spaces between the phosphor pixels of the phosphor layer, or differences in the thickness between the center and the periphery of the panel, increase as the CRT becomes flatter.

SUMMARY OF THE INVENTION

The present invention has been made in an effort to solve at least some of the above problems.

It is a feature of an embodiment of the present invention to provide a CRT panel and a method for manufacturing the same in which the entire area of a viewing screen is uniformly illuminated.

In order to provide for the above feature, the present invention provides a CRT panel that includes a display portion defining a distal end of the panel, a curved lateral wall extending from the display portion toward the funnel having an end joined to a funnel, and a phosphor screen formed on an inner surface of the display portion. The phosphor screen has RGB phosphor pixels and a black matrix layer between the RGB phosphor pixels. The CRT panel is provided with a light transmission compensating member for compensating for differences in brightness of the phosphor screen. The light transmission compensating member is positioned on an outer surface of the display portion while varying light transmission at the center and the periphery of the display portion.

The CRT panel may have a flat surface corresponding to the outer surface of the display portion, and a curved surface corresponding to the inner surface of the display portion. Furthermore, the CRT panel may be formed with a dark-tinted clear glass, a semi-tinted clear glass, or a clear glass.

The ratio of light transmission of the center to the periphery of the light transmission compensating member is preferably established to be in the range of 0.7–0.9:1. Preferably, the panel has total light transmission in the range from 30 to 60%, and more preferably in the range of 38 to 55%.

The light transmission compensating member is formed with a tinted coating layer colored such that the tinted coating layer is dark at a center and gradates increasingly lighter toward a periphery thereof. The tinted coating layer contains a coloring agent selected from metallic oxide, metallic colloid, conductive polymer, coloring pigment, or mixtures thereof.

The metallic oxide is selected from $SnO_2$, $SbO_2$, $In_2O_3$, indium tin oxide (ITO) and antimony tin oxide (ATO) or mixtures thereof. The metallic colloid is selected from Ag, Pd, Au, Ru, Pt, Rh, As, or mixtures thereof. The coloring pigment is selected from carbon black, titan black, graphite, cobalt oxide, nickel oxide, or mixtures thereof. The conductive polymer is selected from polythiophene, polypyrrole, or mixtures thereof.

The amount of the coloring agent in the tinted coating layer is established to be in the range of 0.1 to 1 wt %.

An antistatic coating layer, an antireflection coating layer and a non-glare layer may be sequentially formed on the tinted coating layer.

These and other features and advantages of the embodiments of the present invention will be readily apparent to those of ordinary skill in the art upon review of the detailed description that follows.

BRIEF DESCRIPTION OF THE DRAWINGS

These and other features, aspects, and advantages of the embodiments of the present invention will become better understood with regard to the following detailed description, appended claims, and accompanying drawings where:

DETAILED DESCRIPTION OF THE PREFERRED EMBODIMENTS

Korean Patent Application Serial No. 97-69884, filed on Dec. 17, 1997, and entitled: "CRT Panel and a Method for Manufacturing the Same," is incorporated by reference herein in its entirety.

Several preferred embodiments of the present invention will now be described in detail with reference to the accompanying drawings.

Figure 1:
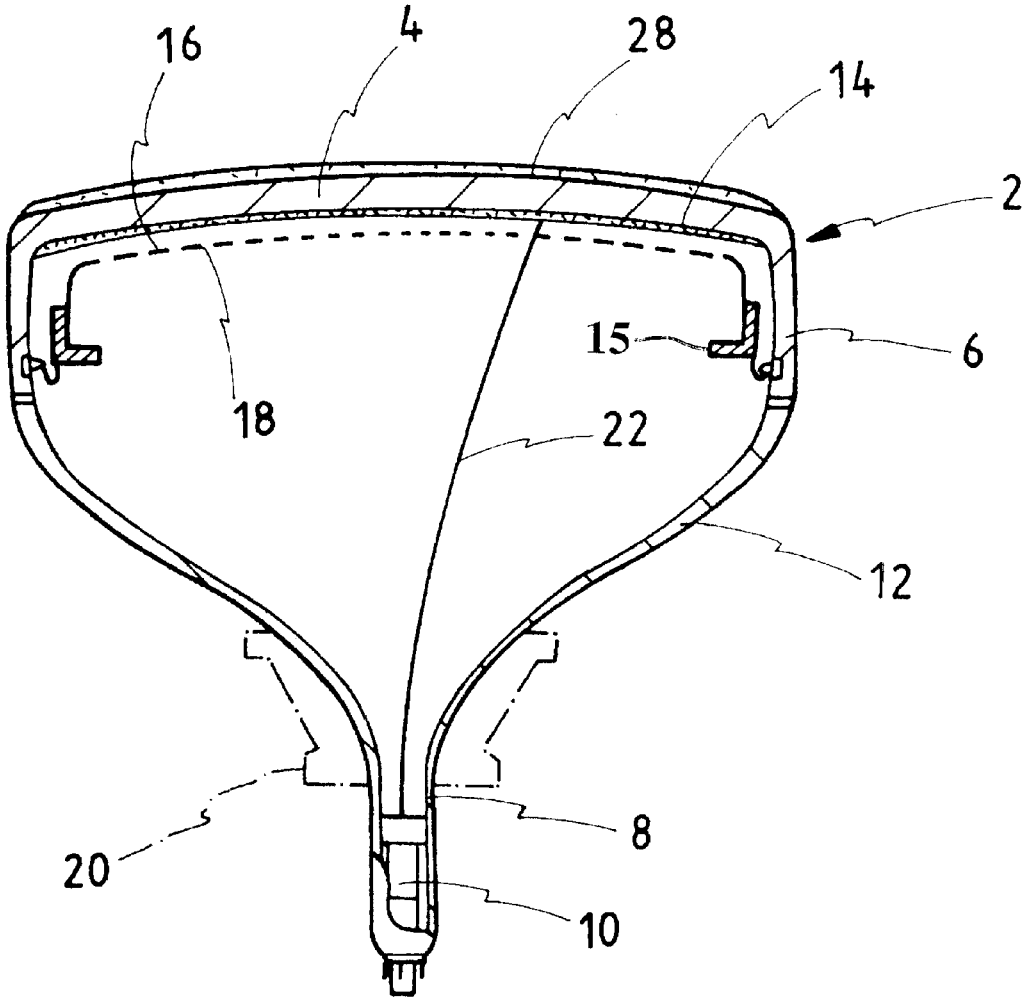
FIG. 1 illustrates a cross-sectional view of a CRT having a panel according to a preferred embodiment of the present invention.

FIG. 1 illustrates a cross-sectional view of a cathode ray tube (CRT) having a panel according to a first preferred embodiment of the present invention. As shown in the drawing, the CRT comprises a panel 2 defining a front exterior of the CRT, and a funnel 12 joined to the panel 2 to define a rear exterior of the CRT. The panel 2 includes a display portion 4 defining a distal end of the panel 2 and a curved lateral wall 6 that extends from the display portion toward the funnel 12 having an end joined to the funnel 12. The funnel 12 includes a neck 8 which is formed on an end of the funnel 12 opposite to the end joined to the panel 2, and an electron gun 10 disposed within the neck 8 of the funnel 12.

A phosphor screen 14 is formed on an inner surface of the display portion 4. The phosphor screen 14 includes a black matrix layer, made of a light-absorbing graphite compound, and red (R), green (G) and blue (B) phosphor pixels. A mask frame 15 is attached to the lateral wall 6, and a shadow mask 16 is connected to the mask frame 15 to be suspended substantially parallel to and at a predetermined distance from the phosphor screen 14.

The electron gun 10 radiates RGB electron beams 22 in a direction toward the panel 2. The RGB electron beams 22 are controlled by image signals, which deflect the beams by an electrical field generated by a deflection yoke 20 disposed on an outer circumference of the funnel 12.

A plurality of apertures 18 is formed in the shadow mask 16, and the electron beams 22 emitted from the electron gun 10 pass through these apertures 18. The apertures 18 perform a color selection function of the electron beams 22 such that the electron beams 22 land on designated phosphor pixels of the phosphor screen 14. The space between each of the apertures 18 increases toward peripheral portions of the shadow mask 16 to correspond to the increased degree of deflection of the electron beams 22 at the periphery of the shadow mask. That is, since the electron beams 22 are deflected in larger arcs towards outer portions of the shadow mask 16, the spaces between the apertures 18 formed in the shadow mask 16 increase such that the electron beams 22 can pass precisely through their designated apertures 18.

Accordingly, the RGB phosphor pixels on the phosphor screen 14 must also be formed in their dot or stripe matrixes with spaces corresponding to the spaces formed between the apertures of the shadow mask (i.e., with larger spaces toward the periphery of the phosphor screen 14). However, this enlarges the area of the black matrix layer between the phosphor pixels, which, in turn, reduces the brightness at the periphery of the display portion 4 such that there is a visible difference in the brightness levels between the center and the periphery of the display area 4.

Furthermore, the thickness of the periphery of the panel 2 is larger than the thickness at the center of the panel 2 to prevent possible stress concentration thereon. With the thickness of the panel 2 increasing toward the periphery, the light transmission of the panel 2 becomes gradually reduced toward the periphery so that the difference in brightness between the center and the periphery of the panel 2 is significant.

According to a feature of an embodiment of the present invention, a light transmission compensating member (preferably formed with a tinted coating layer 28) having light transmission varying at the center and the periphery thereof is provided on an outer surface of the display portion 4 of the panel 2 to compensate for differences in brightness at the display area.

The panel 2 may be formed with a dark-tinted glass having a light transmission of 40 to 50%, a semi-tinted glass having a light transmission of 50 to 60%, or a clear glass having a light transmission of 80 to 90%. Dark-tinted glass not only absorbs light from the outside while improving contrast, but it also absorbs light from the phosphors while reducing brightness. On the other hand, clear glass suffers by diffusing the reflection of light from the outside while reducing contrast, and passes most of the light from the phosphors while improving brightness. Semi-tinted glass exhibits display characteristics in between that of dark-tinted glass and clear glass. In this respect, the panel 2 is preferably formed with a clear glass having a light transmission of about 85% to improve the brightness at the periphery.

The light transmission compensating member is structured such that the periphery thereof has a light transmission higher than the center to compensate for a decrease in brightness at the periphery of the panel 2 due to an increase in the volume of the black matrix portion or in the thickness of the panel 2. In this way, the difference in brightness between the center and the periphery of the panel 2 can be compensated, thereby providing even brightness over the entire display area. It is preferable that the light transmission ratio of the center to the periphery of the light transmission compensating member is in the range of 0.7–0.9:1. The total light transmission of the panel 2 with the light transmission compensating member is preferably in the range of 30 to 60%, and more preferably in the range of 38 to 55%.

Figure 2:
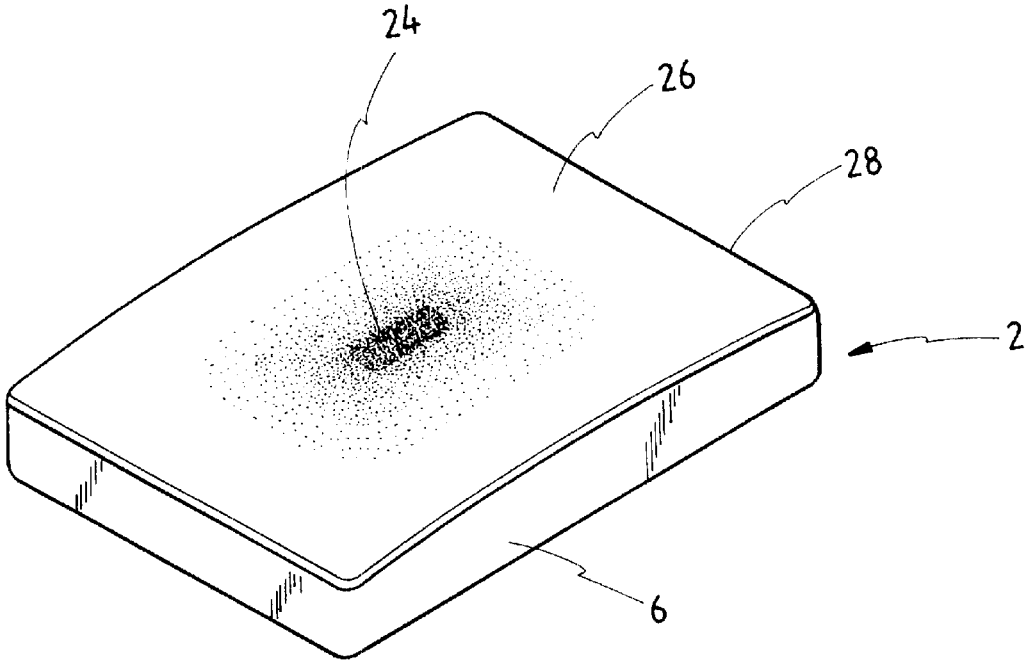
FIG. 2 illustrates a perspective view of the panel shown in FIG. 1.

With reference to FIG. 2, the light transmission compensating member is formed with a tinted coating layer 28. The tinted coating layer 28 is dark at a center 24 of the same, and becomes lighter toward a periphery 26. Since the portion of the tinted coating layer 28 placed at the periphery 26 of the panel 2 bears a lower pigmentation degree and a higher light transmission, it can prevent the brightness of the periphery 26 of the panel 2 from being reduced. The pigmentation content ratio of the center to the periphery of the panel 2 can be easily determined in consideration of the amount of increase in the volume of the black matrix layer or in the thickness of the panel 2.

Figure 3:
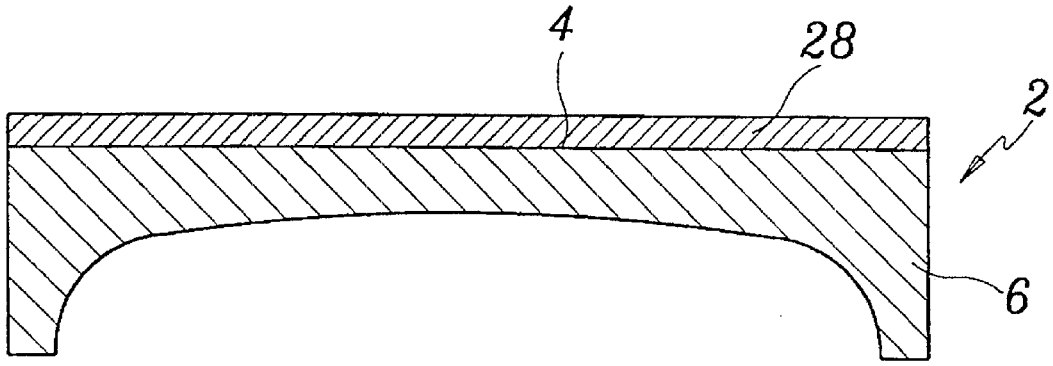
FIG. 3 illustrates a cross-sectional view of a CRT panel according to a second preferred embodiment of the present invention.

FIG. 3 illustrates a cross-sectional view of a CRT panel according to a second preferred embodiment of the present invention. In this preferred embodiment, other components of the CRT panel 2 are the same as those related to the first preferred embodiment except that the CRT panel 2 has a flat outer surface and a curved inner surface, and the tinted coating layer 28 is positioned on the flat outer surface.

As the panel becomes flatter, the difference in the spaces between the apertures of the shadow mask from the center to the periphery thereof increase while the spaces between the phosphor pixels of the phosphor layer are enlarged. This in turn makes the difference in thickness between the center and the periphery of the panel significant, and causes uneven brightness over the display area. The tinted coating layer 28 can be well adapted for compensating for such non-uniform distribution of brightness in the flat panel.

The tinted coating layer 28 is formed by preparing a coating solution where a coloring agent is diffused in an organic solvent such as alcohol, and coating the outer surface of the panel 2 with the coating solution. Metallic oxide, metallic colloid, coloring pigment, conductive polymer, or mixtures thereof may be used for the coloring agent. A conductive metallic oxide such as $SnO_2$, $SbO_2$, $In_2O_3$, indium tin oxide (ITO) and antimony tin oxide (ATO) may be used for the conductive metallic oxide. A colloid of Ag, Pd, Au, Ru, Pt, Rh, As, or mixtures thereof may be used for the metallic colloid. A colloid of Ag/Pd, Ag/Au, Au/Pt, or Au/Ru bearing high conductivity is preferably used for that purpose. An organic or inorganic pigment of carbon black, titan black, graphite, cobalt oxide or nickel oxide, or mixtures thereof may be used for the coloring pigment. The conductive polymer may be selected from polythiophene, polypyrrole, or a derived material thereof. It is preferable that the content of the coloring agent is in the range of 0.1 to 1 wt %.

Figure 4:
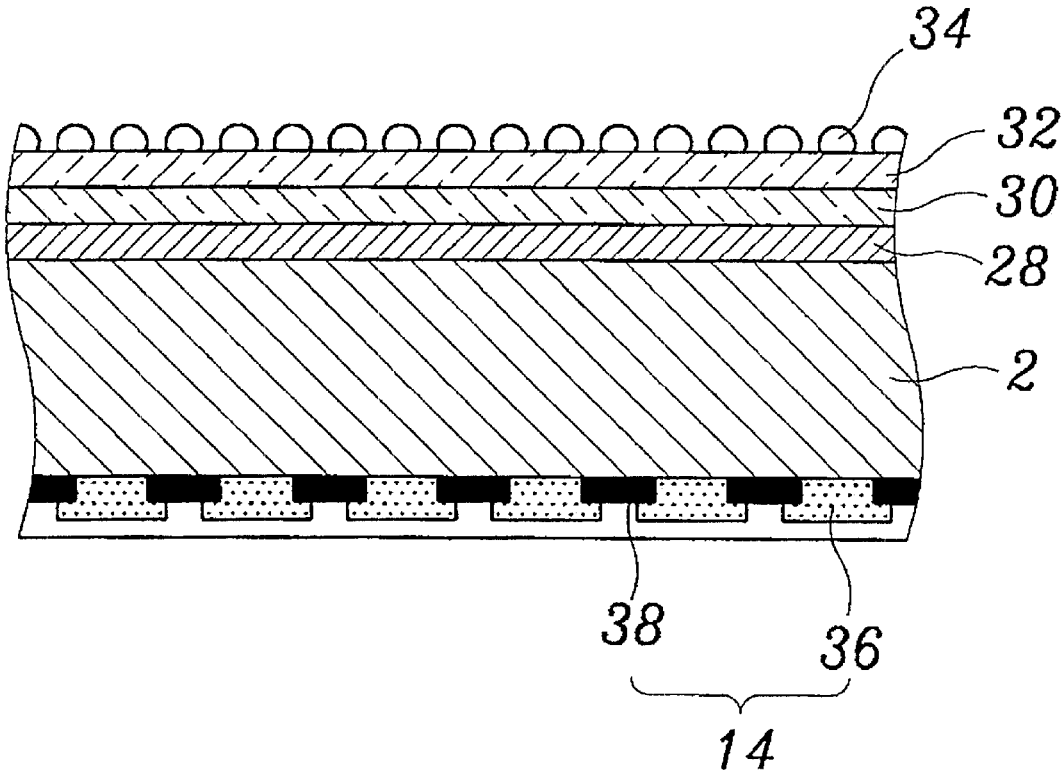
FIG. 4 illustrates a partial-sectional view of a CRT panel according to a third preferred embodiment of the present invention.

FIG. 4 illustrates a partial-sectional view of a CRT panel according to a third preferred embodiment of the present invention. In this preferred embodiment, other components of the CRT are the same as those related to the first preferred embodiment except that an antistatic coating layer 30, an antireflection coating layer 32, and a non-glare layer 34 are sequentially formed on the tinted coating layer 28 on the outer surface of the panel 2.

The antistatic coating layer 30 facilitates control of the light transmission over the entire surface of the panel 2, and gives conductivity to the panel 2. The antistatic coating layer 30 is formed by preparing a coating composition where a metallic colloid is diffused in an organic solvent such as alcohol or water, and spin-coating the coating composition onto the tinted coating layer 28. The antireflection coating layer 32 prevents the panel 2 from reflecting the light from the outside, thereby maintaining suitable contrast of the display images while improving strength of the underlying layer. The antireflection coating layer 32 is formed by preparing a solution where a metallic alkoxide compound such as silicon, zirconium and titanium is reacted with water by way of hydrolysis, and spin-coating the solution onto the antistatic coating layer 30. The non-glare layer 34 is formed by spray-coating the antireflection coating solution onto the anti-reflection coating layer 32.

The metallic colloid used in forming the antistatic coating layer 32 may be the same as that used in forming the tinted coating layer 28. Consequently, the tinted coating layer 28 containing a conductive material may also function as the antistatic coating layer 32. In this case, as shown in FIG. 5, only the tinted coating layer 28 and the antireflection coating layer 32 are formed on the outer surface of the panel 2.

When a solution for forming the tinted coating layer 28 is prepared, a resin-based polymer compound having affinity with the panel 2 may be added to the coating solution as a binder such that the resulting coating layer 28 bears sufficient hardness. A silicate compound such as tetraethyl o-silicate, or metallic oxide such as zirconium oxide and titanium oxide may be used as the resin-based polymer compound.

The method of manufacturing the panel 2 structured as in the above will now be described.

Figure 5:
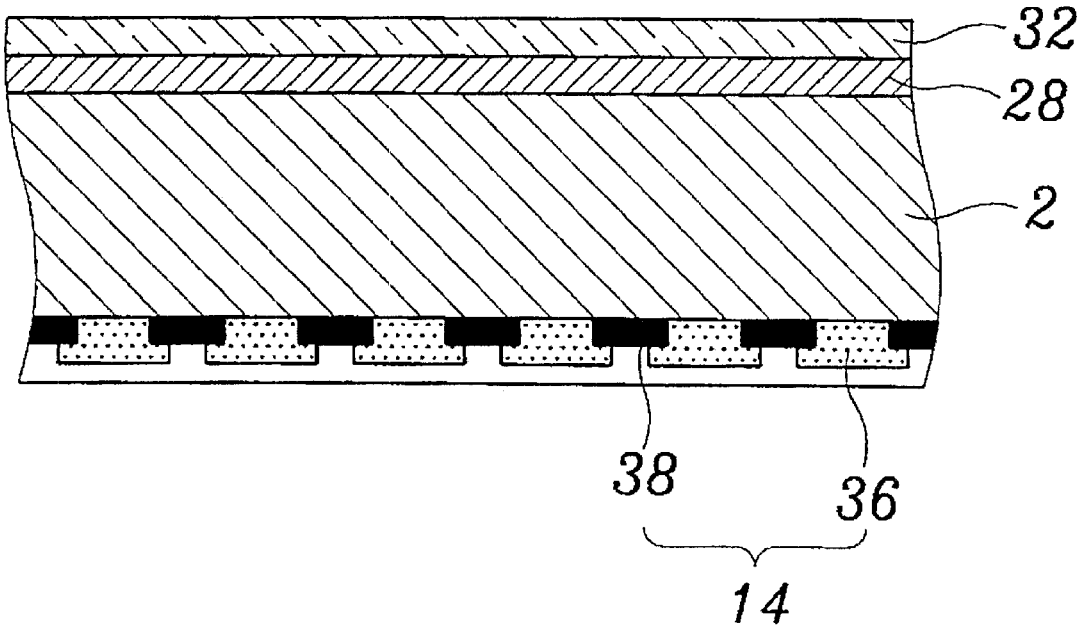
FIG. 5 illustrates a partial-sectional view of a CRT panel according to a fourth preferred embodiment of the present invention.
Figure 6:
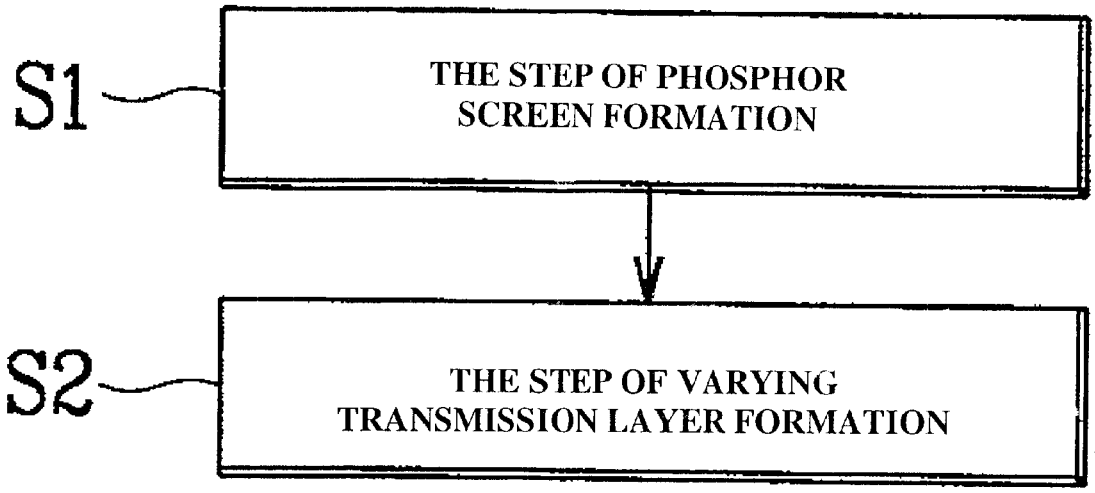
FIG. 6 depicts a flow chart of a manufacturing method of the CRT panel shown in FIG. 1.
Figure 7:
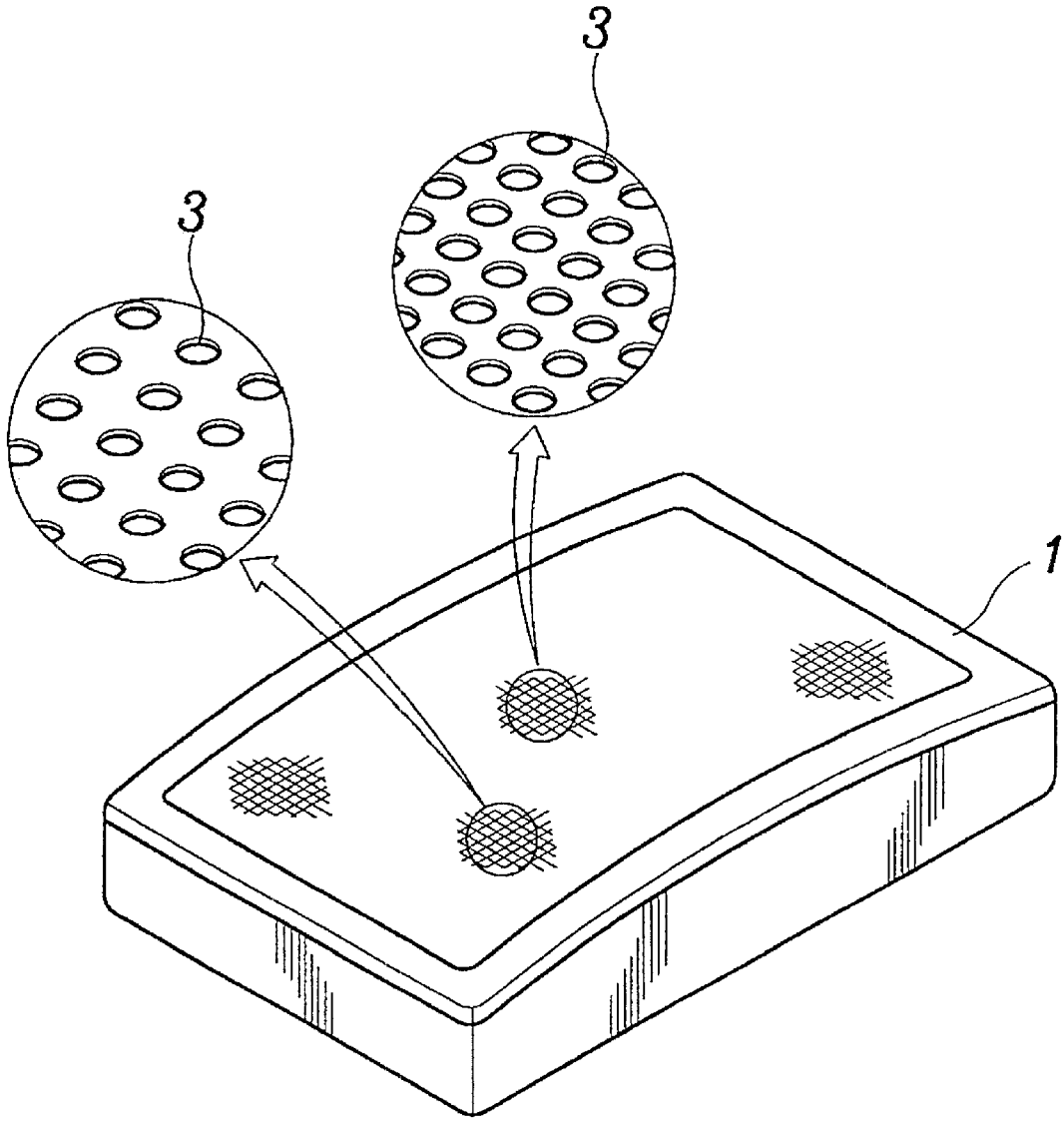
FIG. 7 PRIOR ART
FIG. 7 illustrates a perspective view of a conventional CRT shadow mask according to the prior art.

In addition to the illustrations provided in FIGS. 4 and 5, FIG. 6 depicts a flow chart of a manufacturing method of the panel 2. In step S1, the phosphor screen 14 is formed on the inner surface of the display portion 4 of the panel 2 by depositing black matrix 38 and RGB phosphor materials 36 thereon. In step S2, the tinted coating layer 28 is formed on the outer surface of the display portion 4 of the panel 2 while gradating to a lighter color toward the outer periphery of the display portion 4.

In step S1, as in the conventional method, the panel 2 is coated with an ultraviolet hardening agent, exposed according to a predetermined phosphor pattern, then deposited with a black matrix material and developed, thereby completing the formation of the black matrix layer. A slurry of R, G or B 36 is coated on the black matrix layer, after which the panel is exposed and then developed to complete the formation of the phosphor screen 14 on the inner surface of the display portion 4 of the panel 2.

In step S2, one side of the tinted coating layer 28, which is dark at the center 24 and gradates lighter toward the periphery 26 as described above, is first coated with an adhesive, then the coated side is applied to the outer surface of the display portion 4 of the panel 2, thereby completing the formation of the tinted coating layer 28.

In another embodiment, the tinted coating layer 28 is printed on the outer surface of the display portion 4 of the panel 2 using a printing process.

With the formation of the tinted coating layer on the panel, the brightness over the entire area of the CRT viewing screen is uniform.

In still another embodiment, the tinted coating layer 28 is formed by preparing a solution where a coloring agent is diffused in a solvent, and spray-coating the solution containing a coloring agent onto the outer surface of the display portion 4 of the panel 2. The spray-coating may be performed while controlling the spraying speed, the height of the spraying nozzles, the positional amount of spraying, and the number of spraying nozzles, while mounting a mask at the outer surface of the panel 2.

In yet another embodiment, the tinted coating layer 28 is formed by sputtering a coloring agent being in a solid state onto the outer surface of the panel 2 by way of filters differentiated in opening density.

In a further embodiment, the tinted coating layer 28 is formed by preparing a solution where a coloring agent is diffused in a solvent and an ultraviolet hardening agent is added thereto, and coating the solution onto the outer surface of the panel 2 while varying the amount of illumination in the ultraviolet ray.

The present invention will be further explained by reference to the following examples.

EXAMPLE 1

An Ag/Pd colloid solution was prepared through diffusing Ag of 0.09–0.45 wt % and Pd of 0.015–0.20 wt % in ethanol. A phosphor screen was formed on a clear glass with a light transmission of 85% in a usual way to form a panel. The Ag/Pd colloid solution was spray-coated onto the outer surface of the clear glass opposite to the phosphor screen. At this time, the speed of spraying was gradually increased from the center of the clear glass to the periphery thereof such that the resulting tinted coating layer is dark at the center and gradates lighter toward the periphery.

An Ag/Pd colloid solution was prepared through diffusing Ag of 0.05–0.30 wt % and Pd of 0.01–0.12 wt % in ethanol, and spin-coated onto the tinted coating layer to form an antistatic coating layer. Thereafter, a solution where a silicate compound is reacted with water by way of hydrolysis was prepared, and spin-coated onto the antistatic coating layer to form an antireflection coating layer. The antireflection coating solution was spray-coated onto the antireflection coating layer to form a non-glare layer. In this way, a CRT panel as shown in FIG. 4 was fabricated.

EXAMPLE 2

A CRT panel was fabricated in the same way as with Example 1 except that the Ag/Pd colloid solution for forming the tinted coating layer was prepared through diffusing Au of 0.045–0.35 wt % and Ru of 0.045–0.35 wt % in ethanol.

EXAMPLE 3

A CRT panel was fabricated in the same way as with Example 1 except that the Ag/Pd colloid solution for forming the tinted coating layer was prepared through diffusing titan black of 0.2–0.5 wt % in ethanol.

Comparative Example 1

A CRT panel was fabricated in the same way as with Example 1 except that coating layers excluding the tinted coating layer were formed thereon.

The light transmission of the CRT panels according to Examples 1 to 3 and Comparative Example were measured and the results are listed in Table 1.

TABLE 1

| | Clear glass | Example 1 | Example 2 | Example 3 | Comparative Example 1 |
|---|---|---|---|---|---|
| Light transmission at the center | 81% | 53% | 58% | 51% | 53% |
| Light transmission at the periphery | 70% | 53% | 58% | 51% | 46% |
| Ratio in light transmission of the periphery to the center | 86% | 100% | 100% | 100% | 87% |

As is easily estimated from Table 1, the inventive CRT panel bears uniform light transmission over the entire display area, and serves to improve the brightness characteristic of the CRT.

Although preferred embodiments of the present invention have been described in detail hereinabove, it should be clearly understood that many variations and/or modifications of the basic inventive concepts herein taught which may appear to those of ordinary skill in the present art will still fall within the spirit and scope of the present invention, as defined in the appended claims.

What is claimed is:

1. A panel defining a front exterior of a cathode ray tube having a funnel, the panel comprising:

a display portion defining a distal end of the panel;

a curved lateral wall extending from the display portion toward the funnel, wherein at least an end of the lateral wall is joined to the funnel;

a phosphor screen formed on an inner surface of the display portion, the phosphor screen including RGB phosphor pixels and a black matrix layer between the RGB phosphor pixels; and a light transmission compensating member for compensating for differences in brightness of the phosphor screen, the light transmission compensating member being provided on an outer surface of the display portion while varying light transmission at a center and a periphery of the display portion.

2. The panel of claim 1 comprising a flat surface corresponding to the outer surface of the display portion, and a curved surface corresponding to the inner surface of the display portion.

3. The panel of claim 1 being formed with a material selected from the group consisting of a dark-tinted clear glass, a semi-tinted clear glass, and a clear glass.

4. The panel of claim 1 wherein the ratio of light transmission of a center to a periphery of the light transmission compensating member is in a range of 0.7–0.9:1.

5. The panel of claim 1 having a total light transmission in a range from 30% to 60%.

6. The panel of claim 5, wherein the total light transmission is in a range of 38% to 55%.

7. The panel of claim 1 wherein the light transmission compensating member comprises a tinted coating layer colored such that the tinted coating layer is dark at a center and gradates lighter toward a periphery thereof.

8. The panel of claim 7 wherein the tinted coating layer comprises a coloring agent selected from the group consisting of metallic oxide, metallic colloid, conductive polymer, coloring pigment, and mixtures thereof.

9. The panel of claim 8 wherein the metallic oxide is selected from the group consisting of $SnO_2$, $SbO_2$, $In_2O_3$, indium tin oxide (ITO) and antimony tin oxide (ATO).

10. The panel of claim 8 wherein the metallic colloid is selected from the group consisting of Ag, Pd, Au, Ru, Pt, Rh, As, and mixtures thereof.

11. The panel of claim 8 wherein the coloring pigment is selected from the group consisting of carbon black, titan black, graphite, cobalt oxide, nickel oxide, and mixtures thereof.

12. The panel of claim 8 wherein the conductive polymer is selected from the group consisting of polythiophene, polypyrrole, and mixtures thereof.

13. The panel of claim 8 wherein the amount of the coloring agent in the tinted coating layer is in a range of 0.1 to 1 wt %.

14. The panel of claim 7 further comprising an antireflection coating layer formed on the tinted coating layer.

15. The panel of claim 7 further comprising an antistatic coating layer and an antireflection coating layer sequentially formed on the tinted coating layer.

16. The panel of claim 7 further comprising an antistatic coating layer, an antireflection coating layer and a non-glare layer sequentially formed on the tinted coating layer.

17. The panel of claim 7, wherein the tinted coating layer is printed on the outer surface of the display portion using a printing process.

* * * * *